US006681088B2

(12) United States Patent
Kanno et al.

(10) Patent No.: US 6,681,088 B2
(45) Date of Patent: Jan. 20, 2004

(54) PROCESS CARTRIDGE, IMAGE FORMING APPARATUS AND SEPARATING MECHANISM FOR SEPARATING DEVELOPING MEMBER FROM PHOTOSENSITIVE DRUM

(75) Inventors: Kazuhiko Kanno, Odawara (JP); Kojiro Yasui, Suntoh-gun (JP); Tadashi Horikawa, Susono (JP); Susumu Nittani, Suntoh-gun (JP); Tatsuya Suzuki, Suntoh-gun (JP); Koji Yamaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/066,665

(22) Filed: Feb. 6, 2002

(65) Prior Publication Data

US 2002/0110386 A1 Aug. 15, 2002

(30) Foreign Application Priority Data

Feb. 9, 2001 (JP) ..... 2001/033350
Sep. 19, 2001 (JP) ..... 2001/285144
Jan. 11, 2002 (JP) ..... 2002/004313

(51) Int. Cl.[7] ..... G07G 15/00; G03G 21/18
(52) U.S. Cl. ..... 399/111; 399/228
(58) Field of Search ..... 399/111, 113, 399/112, 119, 222, 228, 234, 223

(56) References Cited

U.S. PATENT DOCUMENTS 5,119,137 A * 6/1992 Katagata ..... 399/116
5,552,857 A * 9/1996 Ishikawa ..... 399/113
5,729,796 A 3/1998 Miura et al. ..... 399/114
5,768,658 A 6/1998 Watanabe et al. ..... 399/111
5,815,644 A 9/1998 Nishiuwatoko et al. ..... 399/113
5,870,655 A 2/1999 Nishiuwatoko et al. ..... 399/111
5,893,006 A 4/1999 Kanno et al. ..... 399/13
5,926,666 A 7/1999 Miura et al. ..... 399/25
5,937,240 A 8/1999 Kanno et al. ..... 399/111
5,940,657 A 8/1999 Yokomori et al. ..... 399/119
5,950,049 A 9/1999 Yokomori et al. ..... 399/119
6,070,029 A 5/2000 Nishiuwatoko et al. ..... 399/111
6,072,969 A 6/2000 Yokomori et al. ..... 399/119
6,459,869 B2 * 10/2002 Nittani et al. ..... 399/111
6,463,234 B2 * 10/2002 Arimitsu et al. ..... 399/113
6,546,218 B2 * 4/2003 Uchida ..... 399/167
2001/0012461 A1 * 8/2001 Yano et al. ..... 399/222
2001/0046393 A1 11/2001 Uchida ..... 399/167

FOREIGN PATENT DOCUMENTS

JP 2001-343809 12/2001

* cited by examiner

*Primary Examiner*—Joan Pendegrass
(74) *Attorney, Agent, or Firm*—Fitzpatrick, Cella, Harper & Scinto

(57) ABSTRACT

A process cartridge detachably mountable to a main assembly of an electrophotographic image forming apparatus, includes a first frame; a second frame coupled with the first frame for rotation about a shaft; an electrophotographic photosensitive drum provided in the first frame; a developing member, provided in the second frame, for developing an electrostatic latent image formed on the photosensitive drum with a developer; a developing member, provided in the second frame, for developing an electrostatic latent image formed on the photosensitive drum with a developer; an elastic member for applying an elastic force between the first frame and the second frame to urge the developing member to the photosensitive drum; a force receiving portion, provided downstream of the shaft with respect to a mounting direction in which the process cartridge is mounted to the main assembly of the image forming apparatus, for receiving a force from the main assembly of the image forming apparatus to keep the developing member away from the photosensitive drum when the process cartridge is mounted to the main assembly of the image forming apparatus; and a limiting portion for limiting upward movement of the first frame.

20 Claims, 12 Drawing Sheets

PROCESS CARTRIDGE, IMAGE FORMING APPARATUS AND SEPARATING MECHANISM FOR SEPARATING DEVELOPING MEMBER FROM PHOTOSENSITIVE DRUM

FIELD OF THE INVENTION AND RELATED ART

The present invention relates to a process cartridge, an electrophotographic image forming apparatus using the same, and a separating mechanism for separating a developing member from an electrophotographic photosensitive drum. The present invention is particularly suitably usable with a color electrophotographic image forming apparatus.

The electrophotographic image forming apparatus forms an image on a recording material through an electrophotographic image formation type process. The electrophotographic image forming apparatus may be an electrophotographic copying machine, an electrophotographic printer (an LED printer, a laser beam printer or the like), an electrophotographic printer type facsimile machine, an electrophotographic printer type word processor or the like.

The process cartridge is a cartridge or unit which contains as a unit at least an electrophotographic photosensitive drum and developing means (developing member) and which is detachably mountable to a main assembly of an electrophotographic image forming apparatus.

In an image forming apparatus using an electrophotographic image forming process, a process cartridge type in which an electrophotographic photosensitive member and process means actable on the electrophotographic photosensitive member are contained as a unit in a process cartridge which is detachably mountable to the main assembly of the image forming apparatus, has been used. The process cartridge type is advantageous in that maintenance operations can be performed not by a service person but by the user in effect, and therefore, operability has been significantly improved. Therefore, the process cartridge type is widely used in the electrophotographic image forming apparatus.

As shown in FIG. 13, there is a color electrophotographic image forming apparatus 200 for a line type in which a plurality of process cartridges are arranged in a line. As for developing means for such cartridges, two types of structures are known. (1) A contact developing system in which the developing roller is kept in contact with the electrophotographic photosensitive drum in the developing operation, and (2) a non-contact developing system in which a predetermined gap is maintained between the photosensitive drum and the developing roller in the developing operation. In either of the types, a predetermined contact pressure or gap is maintained between the developing roller and the photosensitive drum during the developing operation, by urging the developing roller toward the photosensitive drum.

However, in the case of the cartridge of the contact developing system, the developing roller is press-contacted or urged to the photosensitive drum. In other words, an elastic layer of the developing roller is contacted to the photosensitive drum with a predetermined contact pressure. Therefore, if the cartridge is not operated for a long term with the cartridge being set in the main assembly of the image forming apparatus, there is a possibility of permanent deformation of the elastic layer of the developing roller. Because of this, the developed image can be non-uniform.

When the developing roller is not supplied with a bias voltage during the non-operation period (non-image formation), the toner on the developing roller may be deposited on the photosensitive drum. Such toner is liable to contaminate the recording material or the like.

In order to solve this problem, an image forming apparatus has been proposed in which when the image forming operation is not carried out, the developing roller is kept away from the photosensitive drum.

SUMMARY OF THE INVENTION

Accordingly, it is a principal object of the present invention to provide a process cartridge, an electrophotographic image forming apparatus and a separating mechanism for separating the developing member from the electrophotographic photosensitive drum, in which the developing member (developing roller, for example) is assuredly separated from the electrophotographic photosensitive member.

It is another object of the present invention to provide a process cartridge, an electrophotographic image forming apparatus and a separating mechanism for separating the developing member from the electrophotographic photosensitive drum, in which the developing member can be assuredly separated from the electrophotographic photosensitive member, and they can be brought into contact to each other with certainty.

It is a further object of the present invention to provide a process cartridge, an electrophotographic image forming apparatus and a separating mechanism for separating the developing member from the electrophotographic photosensitive drum, in which the developing member is assuredly separated from the electrophotographic photosensitive member except for the developing operation, and during the developing operation, the developing member is assuredly contacted to the electrophotographic photosensitive member with a predetermined contact pressure.

It is a further object of the present invention to provide a process cartridge, an electrophotographic image forming apparatus and a separating mechanism for separating the developing member from the electrophotographic photosensitive drum when the image forming operation is not carried out, and the developing member is assuredly contacted to the photosensitive drum during the image forming operation.

According to an aspect of the present invention, there is provided a process cartridge detachably mountable to a main assembly of an electrophotographic image forming apparatus, comprising a first frame; a second frame coupled with the first frame for rotation about a shaft; an electrophotographic photosensitive drum provided in the first frame; a developing member, provided in the second frame, for developing an electrostatic latent image formed on the photosensitive drum with a developer; a developing member, provided in the second frame, for developing an electrostatic latent image formed on the photosensitive drum with a developer; an elastic member for applying an elastic force between the first frame and the second frame to urge the developing member to the photosensitive drum; a force receiving portion, provided downstream of the shaft with respect to a mounting direction in which the process cartridge is mounted to the main assembly of the image forming apparatus, for receiving a force from the main assembly of the image forming apparatus to keep the developing member away from the photosensitive drum when the process cartridge is mounted to the main assembly of the image forming apparatus; and a limiting portion for limiting upward movement of the first frame.

These and other objects, features and advantages of the present invention will become more apparent upon a consideration of the following description of the preferred embodiments of the present invention taken in conjunction with the accompanying drawings.

DESCRIPTION OF PREFERRED EMBODIMENTS

Figure 1:
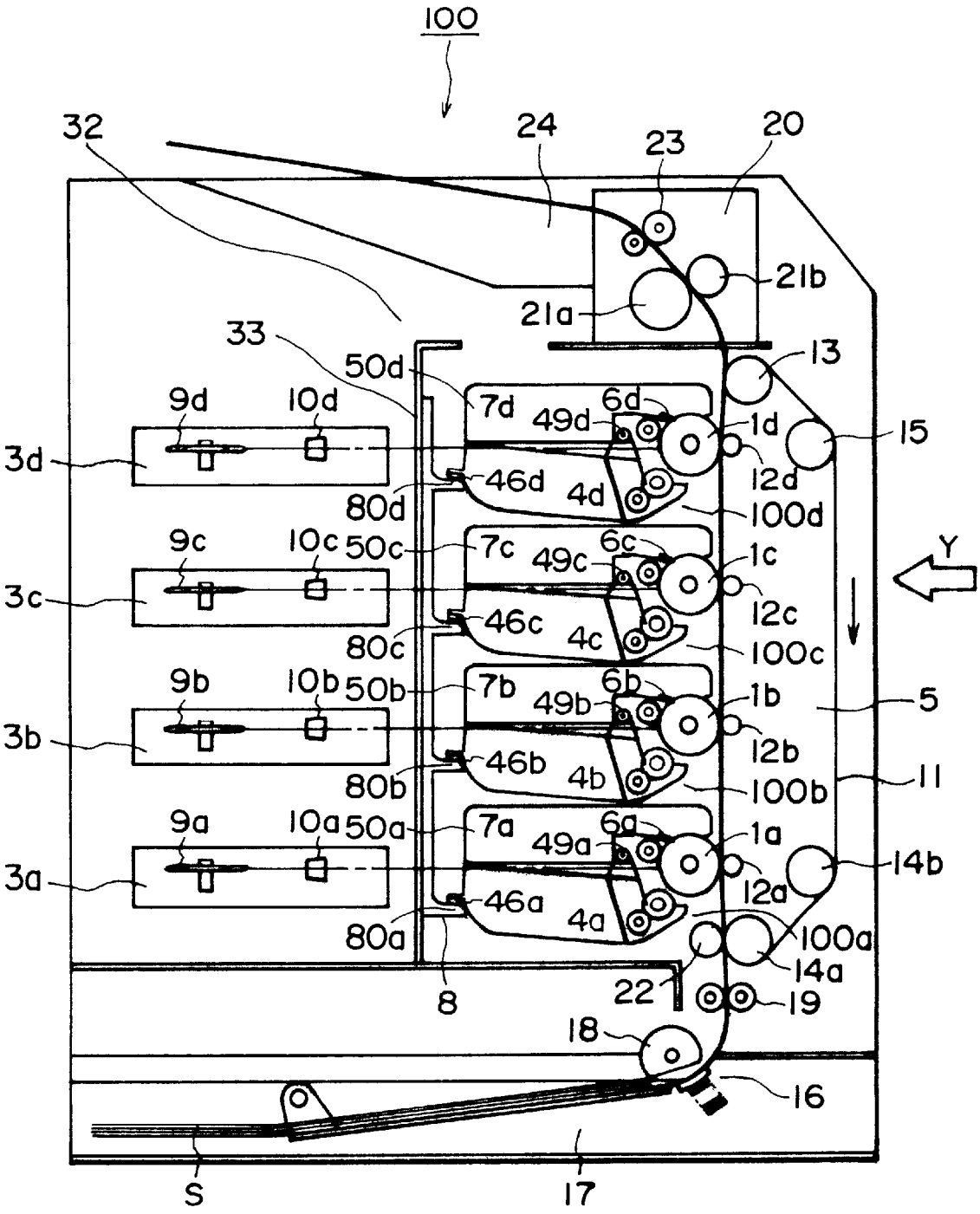
FIG. 1 shows a general arrangement of a color electrophotographic image forming apparatus according to an embodiment of the present invention.
Figure 2:
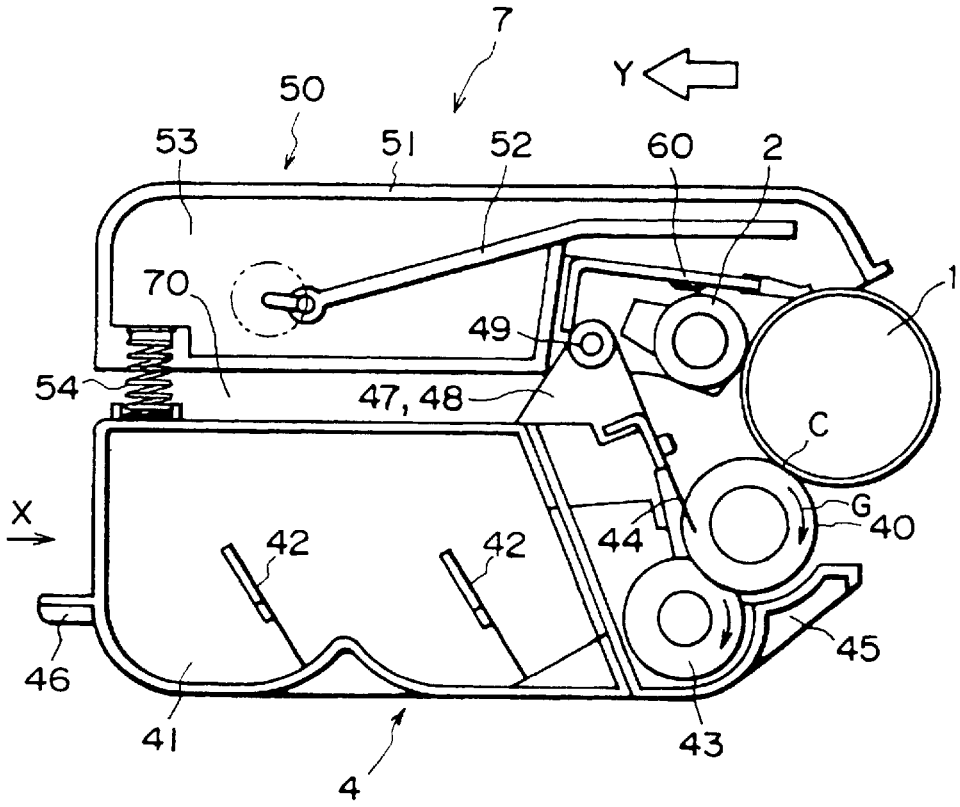
FIG. 2 is a schematic sectional view of a process cartridge.
Figure 3:
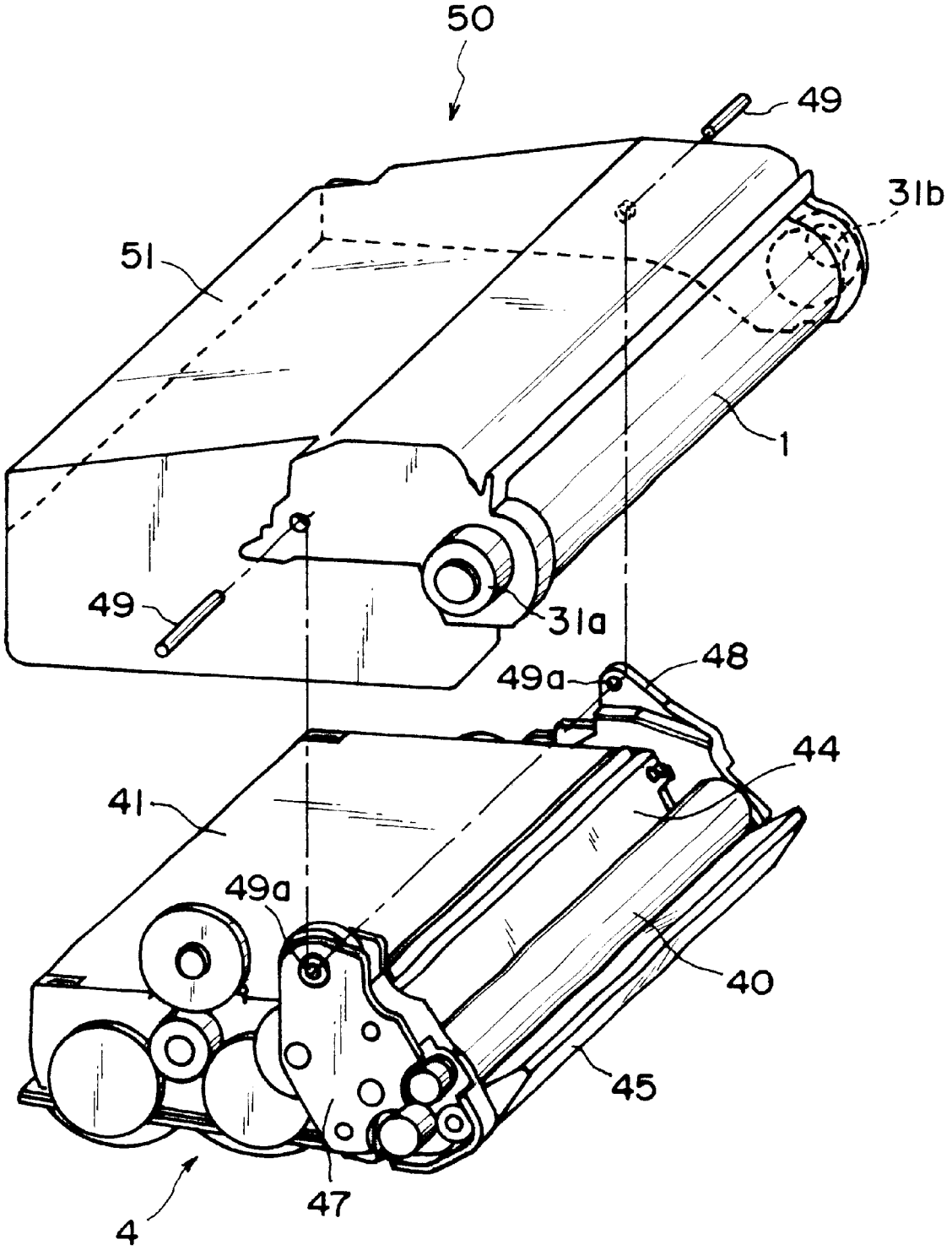
FIG. 3 is an exploded perspective view of a process cartridge.
Figure 4:
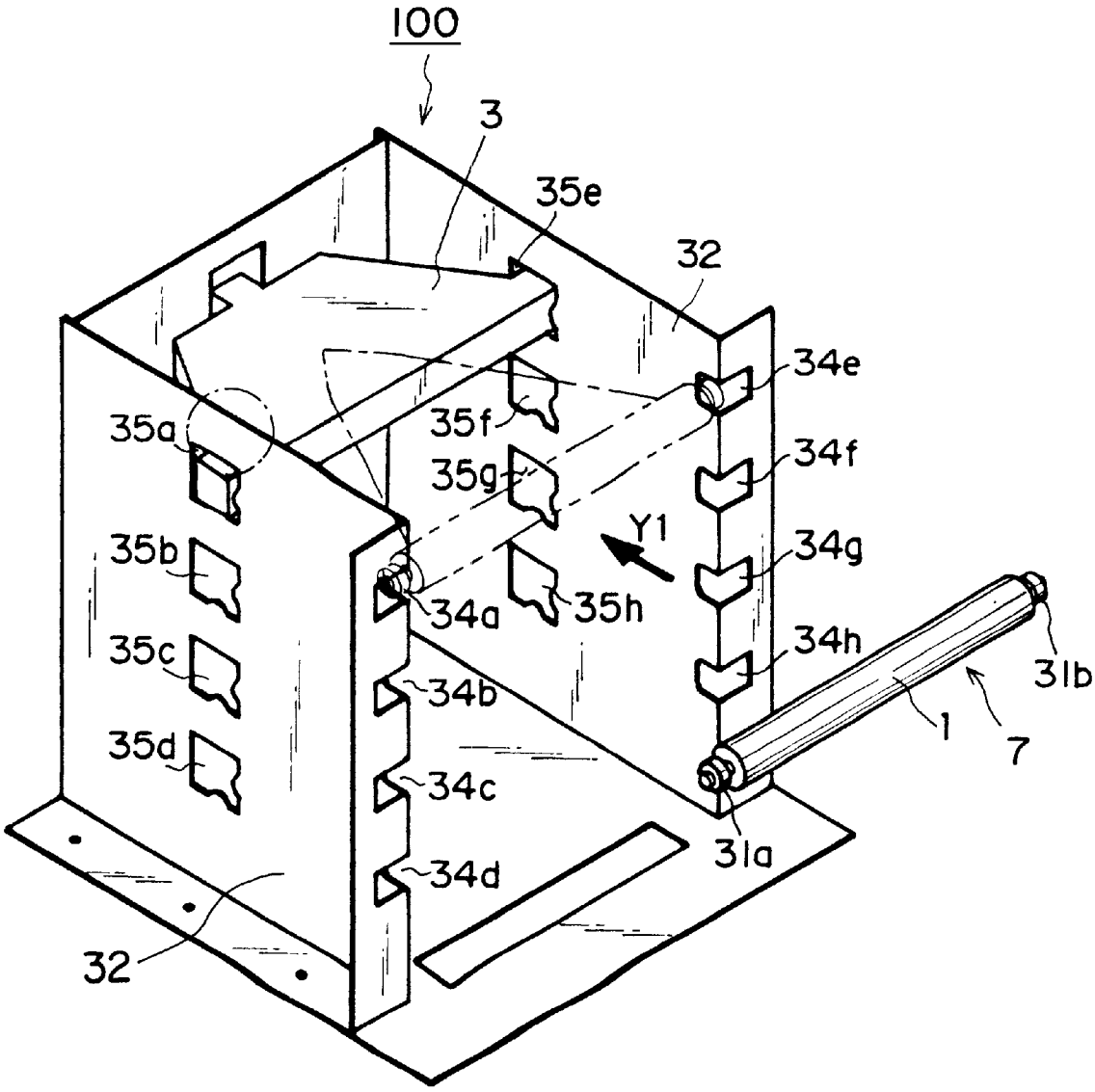
FIG. 4 illustrates a separating mechanism of a cartridge in a main assembly of the apparatus.
Figure 5:
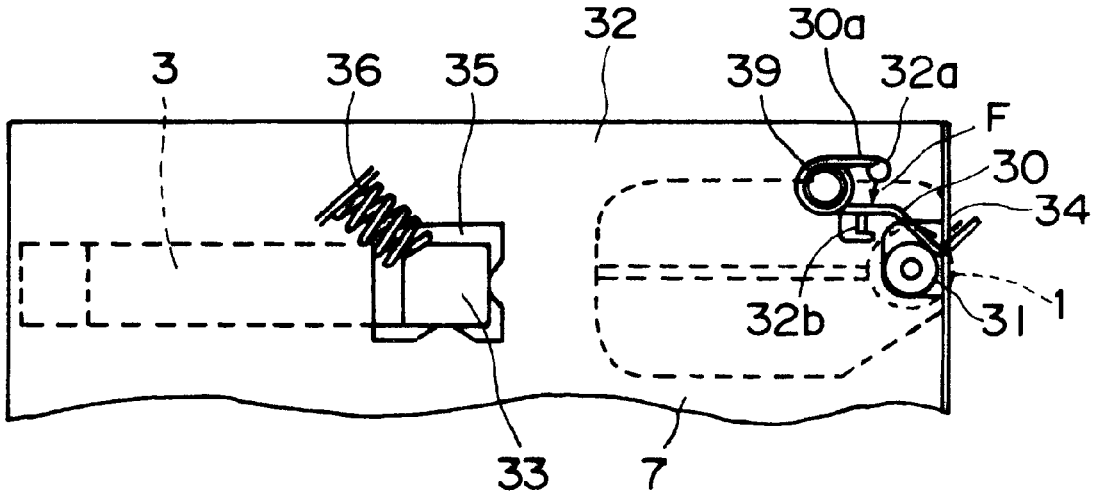
FIG. 5 illustrates a separating mechanism of a cartridge in a main assembly of the apparatus.
Figure 6:
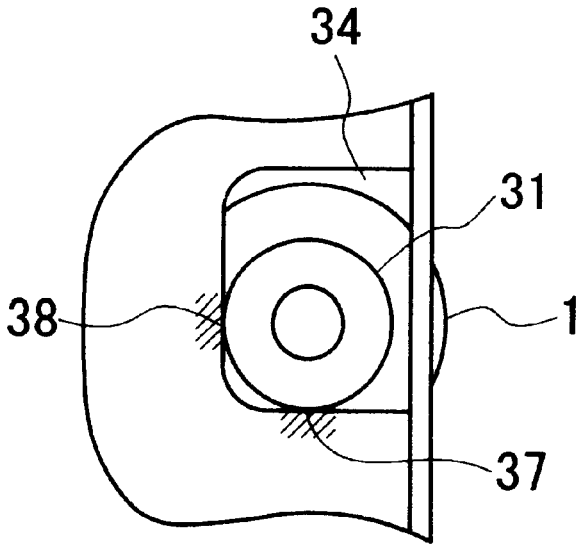
FIG. 6 illustrates a separating mechanism of a cartridge in a main assembly of the apparatus.
Figure 7:
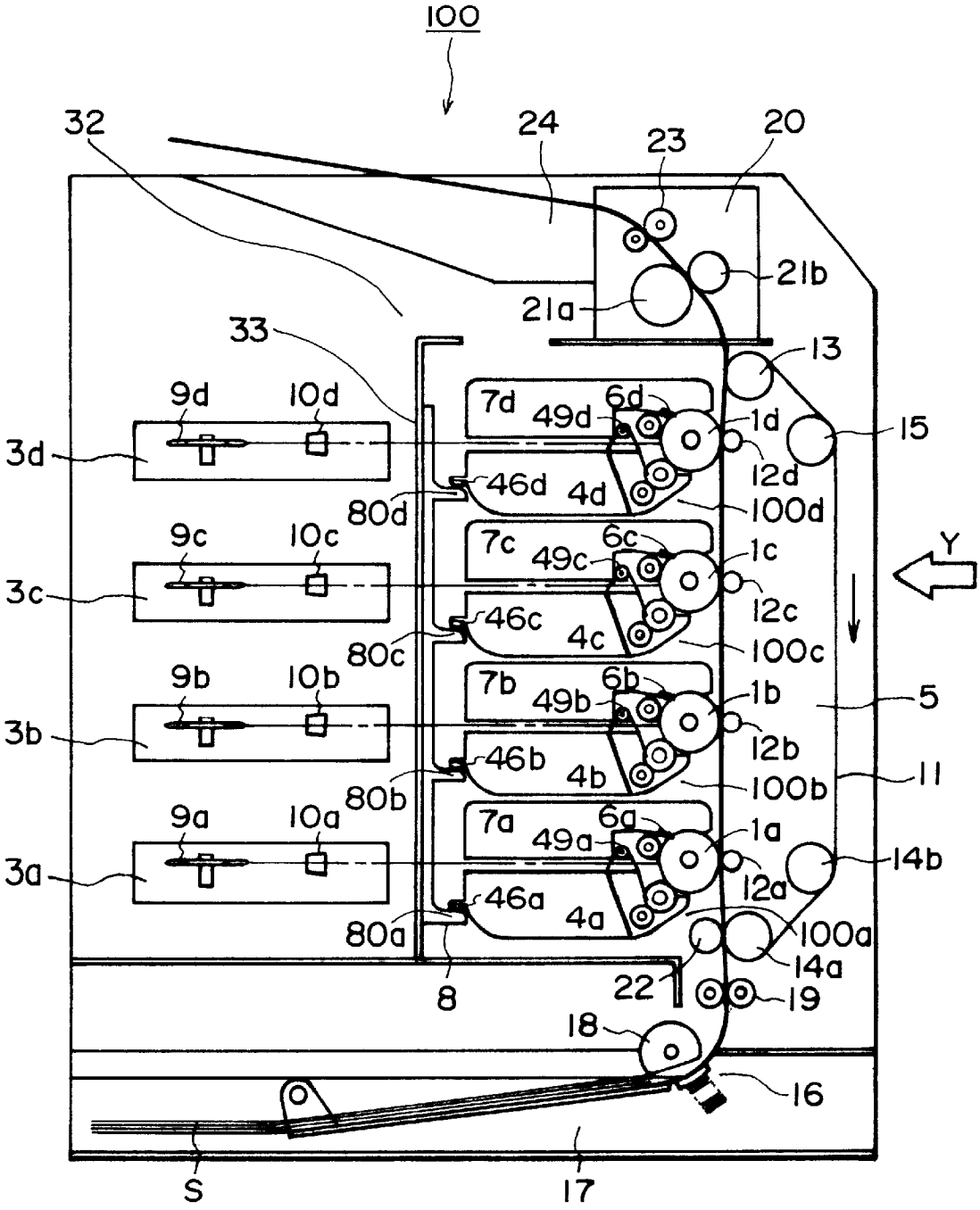
FIG. 7 illustrates the separating and contacting of the developing roller to the photosensitive drum.
Figure 8:
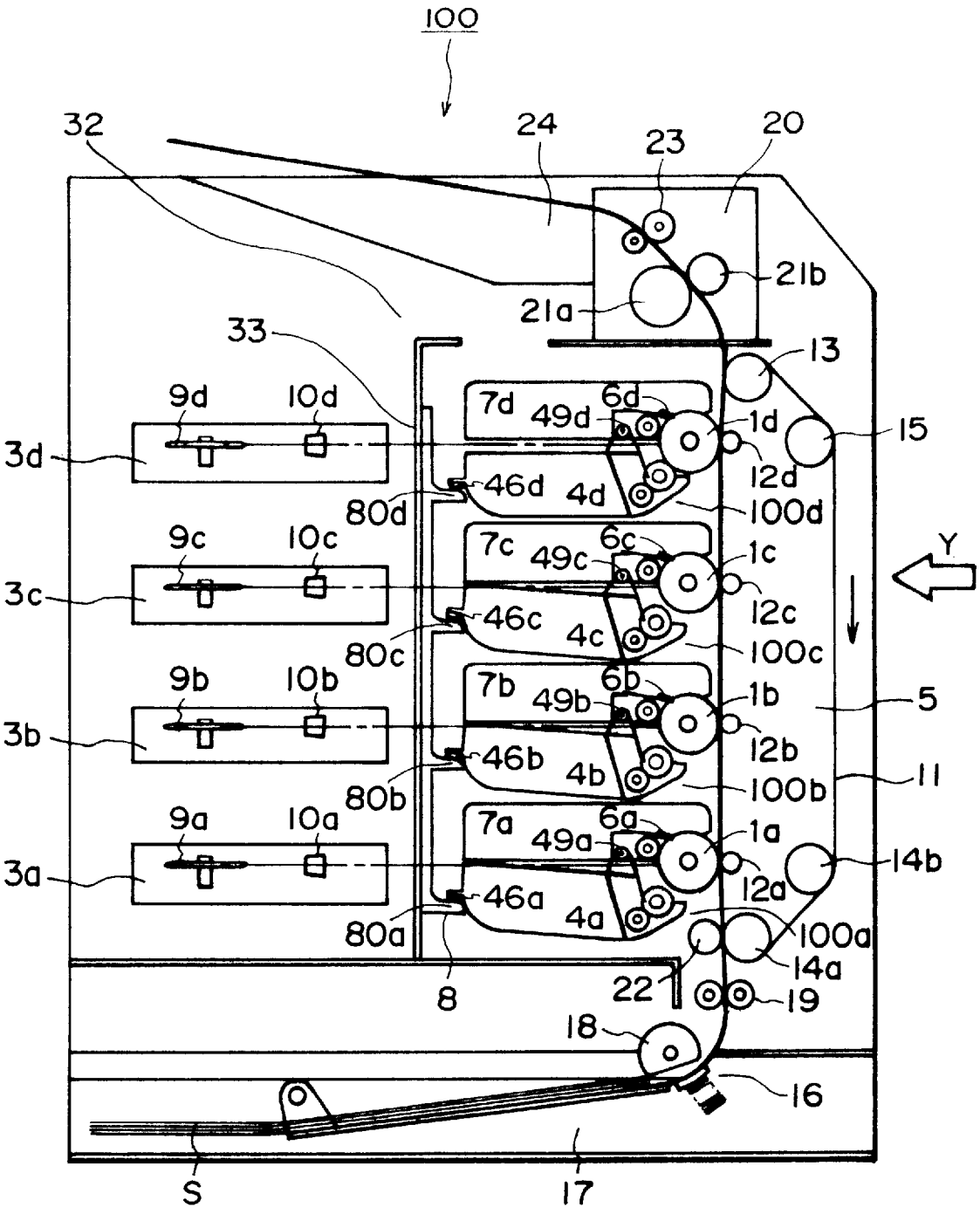
FIG. 8 illustrates the separating and contacting of the developing roller to the photosensitive drum.
Figure 9:
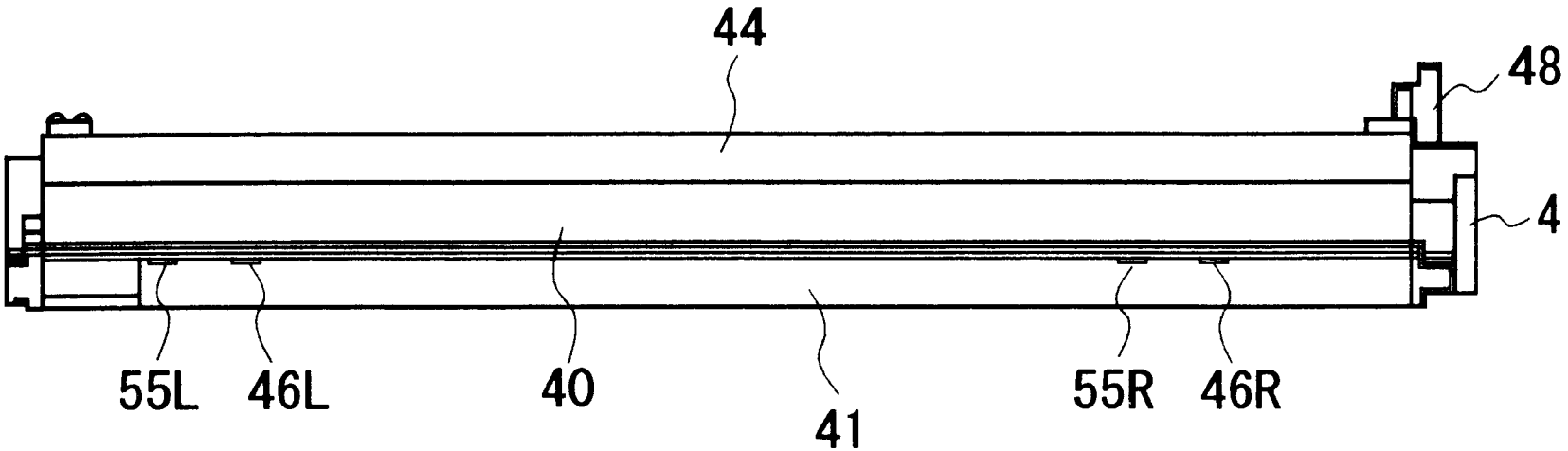
FIG. 9 is an illustration of a force receiving portion of the developing unit.
Figure 10:
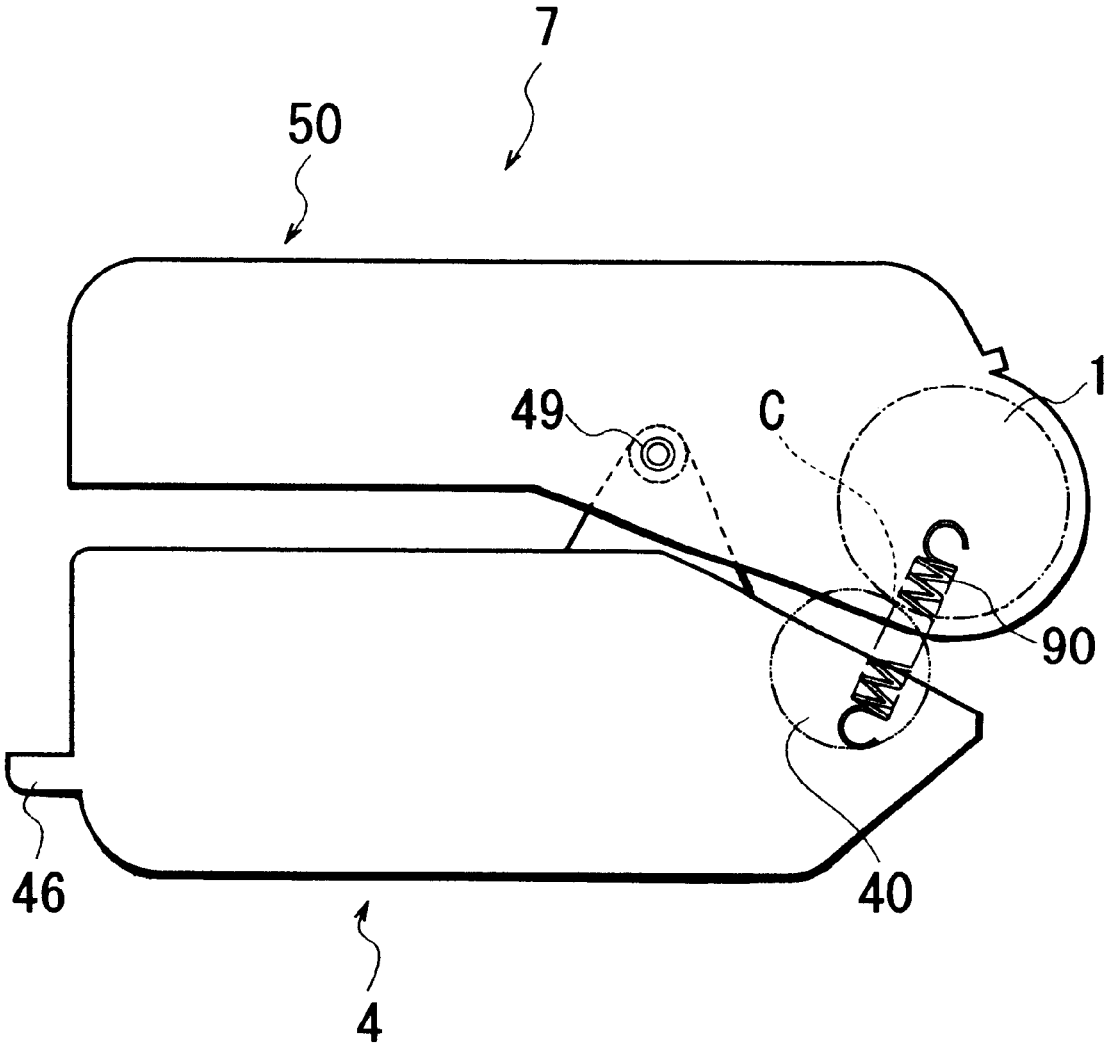
FIG. 10 is an illustration of another example of an urging member for producing an urging force between the photosensitive member unit and the developing unit.
Figure 11:
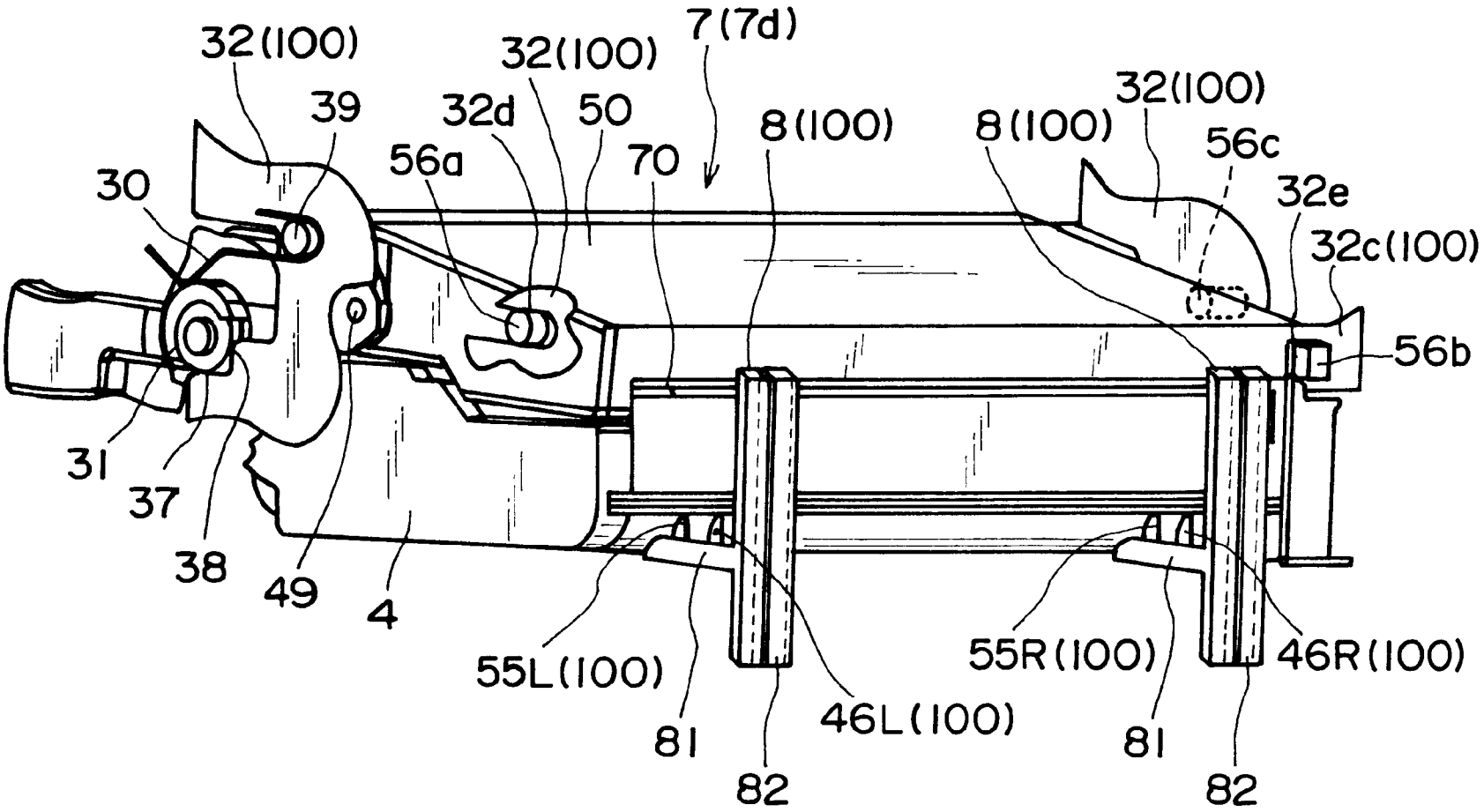
FIG. 11 is a perspective view of a process cartridge when it is mounted to the main assembly of apparatus.
Figure 12:
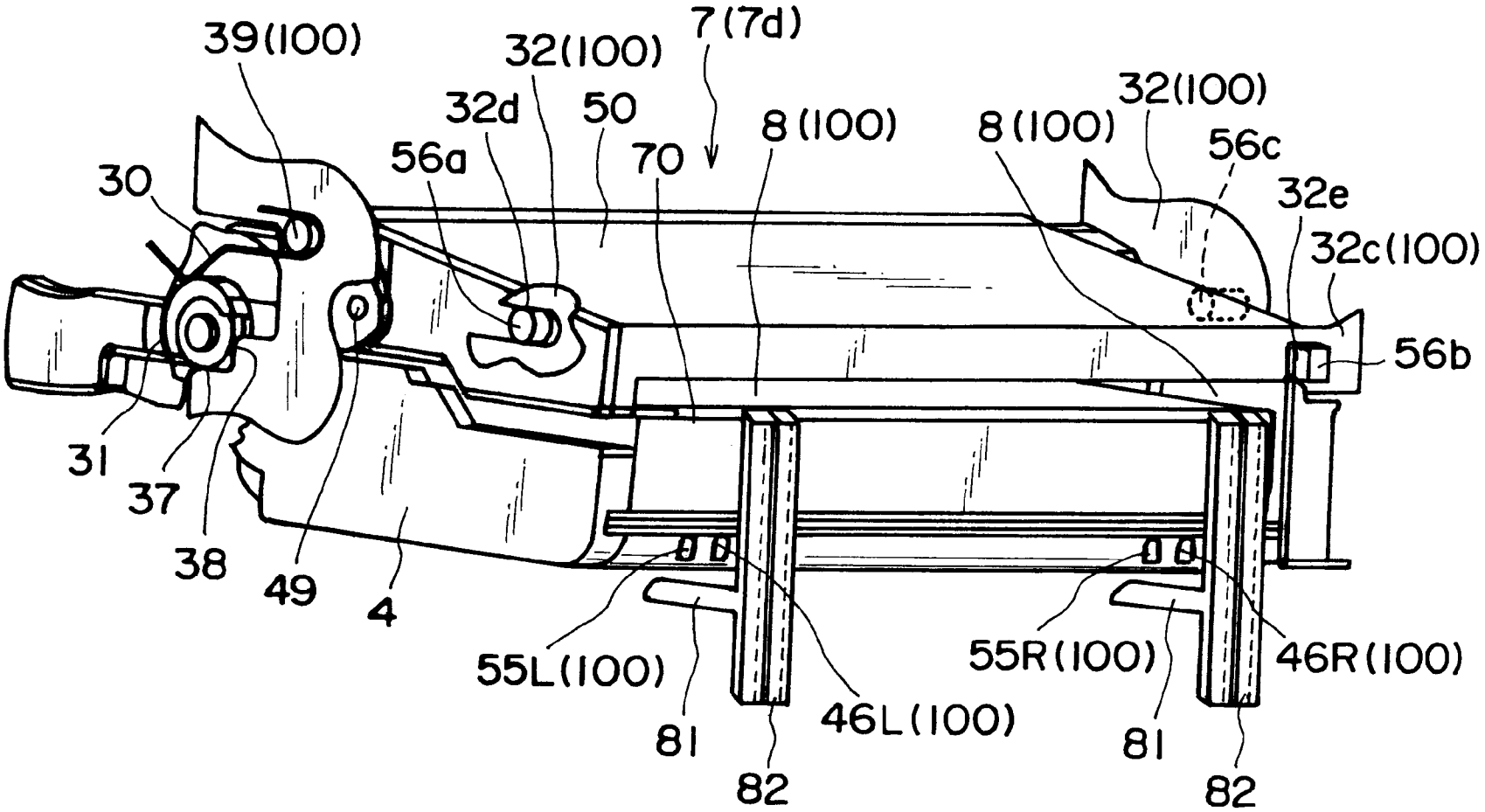
FIG. 12 is a perspective view of a process cartridge which is mounted to the main assembly of apparatus.
Figure 13:
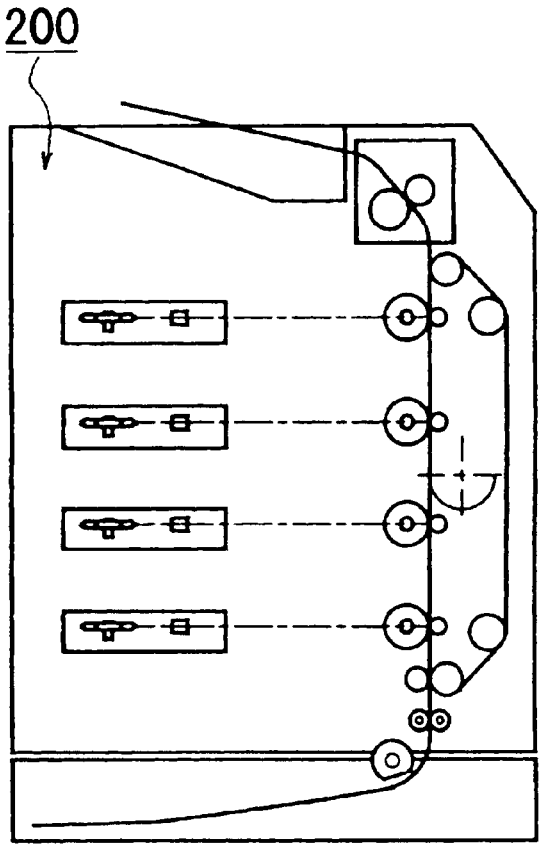
FIG. 13 (PRIOR ART)
FIG. 13 is an illustration of a conventional electrophotographic image forming apparatus.

A description will be provided as to a process cartridge and a color electrophotographic image forming apparatus according to an embodiment of the present invention in conjunction with the accompanying drawings. FIG. 1 shows a general arrangement of a color electrophotographic image forming apparatus according to an embodiment of the present invention; FIG. 2 is a schematic sectional view of a process cartridge; FIG. 3 is an exploded perspective view of the cartridge; FIG. 4 through FIG. 6 are illustrations of a separating mechanism in the main assembly of the apparatus; FIGS. 7 and 8 are illustrations of the separation and contact actions of the developing roller relative to the photosensitive drum; FIG. 9 is an illustration of a force receiving portion of the developing unit; FIG. 10 is an illustration of another example of the urging member for producing an urging force between the photosensitive member unit and the developing unit; and FIGS. 11 and 12 are perspective views of the cartridge set in the main assembly of the apparatus.

(General Arrangement of Image Forming Apparatus)

Referring to FIG. 1, a description will be provided as to the general arrangement of the image forming apparatus. The image forming apparatus 100 shown in FIG. 1 has four process cartridge mounting portions (100*a*–100*d*) which are arranged in the vertical direction. The cartridges 7 mounted to the mounting portions are each provided with one of the electrophotographic photosensitive drums (1*a*–1*d*). The photosensitive drum 1 is rotated in the counterclockwise direction in the figure by a driving means (unshown). Around the photosensitive drum 1, there are provided the following elements in the following order in the direction of peripheral movement of the photosensitive drum 1: charging means 2 for uniformly charging the surface of the photosensitive drum 1; a scanner unit, which comprises one of the scanner units (3*a*–3*d*) for forming an electrostatic latent image on the photosensitive drum 1 by projection of the laser beam in accordance with image information; a developing unit (second frame) 4, which comprises one of the developing units 4*a*–4*d*, for developing the electrostatic latent image with a developer (toner); electrostatic transferring means 5 for transferring the toner image from photosensitive drum 1 onto a recording material S; and cleaning means comprising one of the cleaning means (6*a*–6*d*) for removing the toner remaining on surface of photosensitive drum 1 after the image transfer. Here, the photosensitive drum 1, the charging means 2, the developing unit 4 and the cleaning means are unified into a process cartridge.

The photosensitive drum 1 comprises an aluminum cylinder having a diameter of 30 mm, for example and an organic light direction transmission member layer (OPC photosensitive member) applied on an outer surface thereof. The photosensitive drum 1 is rotatably supported at the opposite end portions by supporting members. At one of the end portions, a driving force is transmitted from a driving motor (unshown). By this, the photosensitive drum 1 is rotated in the counterclockwise direction. The charging means 2 in this embodiment is a contact charging type charging means, as shown in FIG. 2. The charging member is an electroconductive roller, which contacts the surface of the photosensitive drum 1. The charging roller 2 is supplied with a charging bias voltage. By doing so, the surface of the photosensitive drum 1 is uniformly charged electrically.

The scanner unit 3 is disposed substantially at the same level as the photosensitive drum 1. The image light corresponding to the image signal emitted by a laser diode (unshown) is directed to one of the polygonal mirrors 9*a*–9*d* rotated by a scanner motor (unshown). The surface of the photosensitive drum 1 having been electrically charged is selectively exposed to image light reflected by one of the mirrors 9*a*–9*d* through one of imaging lens 10*a*–10*d*. By this, an electrostatic latent image is formed in accordance with the image signal. The unit 3 is longer than the length between the left and right plates in the longitudinal direction as shown in FIG. 5. A projection 33 is projected outward through openings 35*a*–35*h* formed in the left and right plates 32. The unit 3 is urged in the direction indicated by the arrow (downward and 45° inclination) by a compression spring 36 with approximately 9.8N. By doing so, the unit 3 is assuredly urged and currently positioned.

As shown in FIG. 2, the developing unit 4 includes a toner container 41 and since there are four cartridges 7, each with one of the developing units 4*a*–4*d*, developing unit 4*a* includes toner container 41*a* accommodating yellow color toner, developing unit 4*b* includes a toner container 41*b* containing magenta color toner, developing unit 4*c* includes a toner container 41*c* containing cyan color toner, and developing unit 4*d* includes toner container 41*d* containing black color toner. Each developing unit also includes a developing device frame 45. A toner feeding mechanism 42 is provided in each developing unit to feed the toner from the inside of the toner container 41 to the toner supplying roller 43. In each developing unit, the toner is applied on the outer periphery of the developing roller 40 by a developing blade 44 press-contacted to the outer periphery of the developing roller 40. And, the toner is electrically charged. The developing roller 40 is supplied with a developing bias so that a latent image formed on the photosensitive drum 1 is developed. The developing roller 40 is disposed opposed to the photosensitive drum 1.

On the other hand, as shown in FIG. 1, the image forming apparatus comprises an electrostatic transfer belt 11 which moves along an endless path so that it is opposed to all of the photosensitive drums 1*a*–1*d*. The transfer belt 11 is made of a material having a thickness of approximately 150 $\mu$m and having a volume resistivity of $10^{11}$–$10^{14}$ Ωcm. The transfer belt 11 is supported by four rollers (4 axes) and travels in the vertical direction. The recording material S is fed to the image transfer station by the transfer belt 11, where the toner image is transferred from the photosensitive drum 1 onto the recording material S. The transfer rollers 12*a*–12*d* are opposed to the photosensitive drums 1*a*–1*d* and contact the inside of the transfer belt 11. The positive charge is applied to the recording material S from the transfer rollers 12*a*–12*d* to the transfer belt 11. By this, the toner image is transferred from the photosensitive drum 1 onto the recording material S. The transfer belt 11 is extended on four rollers, namely, a driving roller 13, follower rollers 14*a*, 14*b* and a tension roller 15, and is rotatable in the direction indicated by an arrow in FIG. 1. With this arrangement, the toner image is transfered onto the recording material S while the recording material S is fed from the follower roller 14*a* side to the driving roller 13 side by the circulation movement of the transfer belt 11.

The feeding portion 16 functions to supply the recording material S to the image formation station. A plurality of recording materials S are accommodated in the feeding cassette 17. During image formation, a feeding roller 18 and registration rollers 19 are rotated in accordance with the image forming operation. The recording material S is fed out of the cassette 17 seriatim. And, the leading end of the recording material S is abutted to the nip formed between the rollers 19. The recording material S is fed to the transfer belt 11 by the registration rollers 19 in a timed relation with the rotation of the transfer belt 11 and the formation of the toner image on the photosensitive drum.

The fixing portion 20 functions to fix the toner images of different colors having been transferred onto the recording material S. The fixing means comprises a rotatable heating roller 21*a* and a pressing roller 21*b* press-contacted to the heating roller 21*a* to apply heat and pressure to the recording material S. The recording material S now having the toner image transferred from the photosensitive drum 1 is fed by the heating roller 21*a* and pressing roller 21*b* while it is passed through the fixing portion 20. During this feeding operation, heat and pressure is applied to the recording material by the rollers 21*a* and 21*b*. By this, the toner image of the plurality of colors is fixed on the surface of the recording material S.

The image forming operation will be described. The cartridges 7*a*–7*d* are sequentially driven in synchronism with image forming operation. By this, the photosensitive drums 1*a*–1*d* are rotated. Then, the scanner units 3 for the cartridges 7 are sequentially actuated. Then, the charging means 2 electrically charges the surface of the photosensitive drum 1 uniformly. The peripheral surface of the photosensitive drum 1 is exposed to the light modulated in accordance with an image signal, so that an electrostatic latent image is formed on the photosensitive drum 1. The developing roller 40 develops the electrostatic latent image.

As described in the foregoing, the toner image is sequentially transferred from the photosensitive drums 1 onto the recording material S by the electric fields formed between the photosensitive drums 1 and the transfer rollers 12*a*–12*d*. The recording material S now having the transferred four color toner image is separated from the transfer belt 11 by the curvature of the driving roller 13. Then, it is fed into the fixing station 20. The toner image is fixed on the recording material S by the heat and pressure in the fixing portion 20, and thereafter, it is discharged to outside of the main assembly from the discharging portion 24 by the discharging rollers 23.

(Process Cartridge)

Referring to FIG. 2, a description will be provided as to the process cartridge according to an embodiment of the present invention. FIG. 2 is a sectional view of the cartridge 7 accommodating the toner. The cartridge 7*a* accommodating normal yellow color toner, a cartridge 7*b* accommodating magenta color toner, cartridge 7*c* accommodating cyan color toner, and cartridge 7*d* accommodating black color toner, have the same structures.

The cartridge 7 (7*a*–7*d*) comprises a photosensitive member unit 50 (50*a*–50*d*) (first frame) including a photosensitive drum 1 (1*a*–1*d*), charging means 2, cleaning means (6*a*–6*d*), and a developing unit 4 (4*a*–4*d*) (second frame) including developing means.

In the unit 50, the photosensitive drum 1 is rotatably mounted to the cleaning frame 51 by bearings 31*a*, 31*b*. Around the photosensitive drum 1, there is provided charging means 2 and the cleaning blade 60. The residual toner removed from the surface of the photosensitive drum 1 by the cleaning blade 60, is fed into a removed toner chamber 53 provided behind the cleaning frame, by a toner feeding mechanism 52. The unit 50 receives a driving force from a driving motor (unshown), by which the photosensitive drum 1 is rotated for an image forming operation.

The developing unit 4 comprises a developing roller 40 which is rotatable in the direction indicated by an arrow G in contact with the photosensitive drum 1, a toner container 41 accommodating the toner, and a developing device frame 45. The developing roller 40 is rotatably supported on the developing device frame 45 by bearing members. As described in the foregoing, the peripheral surface of the developing roller 40 is contacted by the photosensitive drum 1, the toner supplying roller 43 and the developing blade 44. In the toner container 41, there is provided a toner feeding mechanism 42 for stirring the toner accommodated therein and for feeding the toner to the roller 43.

The developing unit 4 as a whole is pivotably mounted to the photosensitive member unit 50. More particularly, the developing unit 4 is rotatable relative to the unit 50 about the shaft shaft 49 (pivot) engaged in the holes 49*a* of bearing members 47, 48 mounted to the opposite ends of the unit 4. When the cartridge 7 is not mounted to the main assembly of the printer, the developing unit 4 is normally urged by a pressing spring 54 (compression coil spring) and a pressing spring 90 (elastic members) so that developing roller 40 is contacted to the photosensitive drum 1 by the rotation moment about the shaft 49. The toner container 41 of the developing unit 4 is integrally provided with a force receiving portion 46 (46*a*–46*d*) in the form of a rib for abutment by a separation means (which will be described hereinafter) of the main assembly 100 of the apparatus when the developing roller 40 is to be separated from the photosensitive drum 1. The shaft 49 is provided between the developing roller 40 and the rear end of the toner container 41. The developing roller 40 is spaced from the photosensitive drum 1 with a predetermined gap therebetween by raising the force receiving portion 46. At this time, by the regulating portion which will be described hereinafter in conjunction with FIG. 11 and FIG. 12, the unit 50 is prevented from upward movement.

In the case of a contact developing system in which the developing operation is carried out while the developing roller 40 is in contact with the photosensitive drum 1, it is preferable that photosensitive drum 1 is rigid, and the developing roller 40 is elastic. The elastic member may be a solid rubber monolayer, or a solid rubber layer coated with a resin material in consideration of the charging application property to the toner.

(Separation Mechanism for Separation Between Photosensitive Drum and Developing Member in Process Cartridge)

Referring to FIG. 4 through FIG. 12, a description will be provided as to a separation mechanism which is operative when the cartridge 7 is dismounted from the main assembly 100 of the apparatus. In FIG. 4, the cartridge 7 is omitted, and only the photosensitive drums 1 and the bearings are shown, for better understanding of the cartridge 7 mounting structure. FIG. 11 and FIG. 12 are perspective views of the cartridge 7 in which the cartridge 7 is mounted to the main assembly. In FIG. 11, the force receiving portions 55L, 55R are raised by a force applying member 8. FIG. 12 shows a state in which the force receiving portions 55L, 55R and the force applying member 8 are spaced from each other.

As described in the foregoing, in the cartridge 7 per se (not mounted to the main assembly of apparatus), the developing roller 40 (developing member) normally contacts the photosensitive drum 1. In the mounting to the main assembly 100 of the apparatus, the bearing supporting the photosensitive drum 1 is inserted along the guide grooves 34*a*–34*h* (FIG. 4 in which the cartridge mounting direction is indicated by an arrow). As shown in FIG. 6, the bearing 31 is pressed against the abutment surfaces 37, 38 of the guide groove 34, by which the position of the cartridge 7 is determined relative to the main assembly of the apparatus. The urging method of the cartridge 7 in the main assembly of the apparatus will be described. As shown in FIG. 5, the shaft 39 is crimped to the side plate 32. A twisted coil spring 30 is supported on the shaft 39. The end 30*a* is fitted into the hole 32*a* and is fixed there. When the cartridge 7 is not mounted to the main assembly of the apparatus, the spring 30 is limited by the erected portion 32*b* in the rotational direction. When the cartridge 7 is inserted, the spring 30 is rotated in the counterclockwise direction against the spring force of the spring 30. When it rides over the bearing, it elastically urges the bearing 31.

Referring to FIGS. 1, 7 and FIG. 8, a description will be provided as to the separation means. In a rear side of the main assembly 100 of the apparatus with respect to the inserting direction of the cartridge 7, there is provided a separation means (force applying member 8) for separating the developing roller 40 from the photosensitive drum 1 against the urging force of the developing unit 4. The force applying member 8 has separation plates 80*a*–80*d* for raising the force receiving portions 46*a*–46*d* provided in the developing units 4*a*–4*d* for the yellow, magenta, cyan and black developers. The force applying member 8 is moved vertically by a stepping motor (unshown). The separation plates 80*a*–80*d* of the force applying means 8 are movable between a separation position in which they raise the receiving portions 46*a*–46*d* by which the developing roller 40 is separated from the photosensitive drum 1 (separation position) and a developing position in which the separation plates 80*a*–80*d* are not raised and take a lower position so that the separation plates 80*a*–80*d* are separated from the force receiving portions 46*a*–46*d*, and therefore, developing roller 40 contacts the photosensitive drum 1. Only during the image forming operation, the raising of the separation plates 80*a*–80*d* is disabled so as to move the developing unit 4 to the developing position. By releasing the raising action of the separation plates 80*a*–80*d*, the developing roller 40 is brought into contact to the photosensitive drum 1 by the elastic force of the spring 54.

FIG. 9 is a view of the cartridge 7 as seen in the direction indicated by an arrow X in FIG. 2.

With this structure, there are provided two pairs of receiving portions 46L, 46R, 55L, 55R arranged in the longitudinal direction of the cartridge 7. When the separation plates 80*a*–80*d* are raised so that developing roller 40 is separated from the photosensitive drum 1, the separation plates 80*a*–80*d* are contacted simultaneously to the force receiving portions 46R, 46L or to the force receiving portions 55L, 55R of each developing unit 4*a*–4*d*. By doing so, the developing roller 40 is prevented from being separated with inclination in the longitudinal direction. In FIGS. 1, 2, 7 and FIG. 8, the example in which the force receiving portion 46 is projected frontward with respect to the mounting direction Y (FIG. 2), is shown. In FIGS. 9, 11, and 12, the force receiving portions 46, 55L, 55R are provided on the lower surface of the unit 4 and are oriented downward.

The releasing of the raising of the separation plates 80*a*–80*d* includes three modes, namely, (1) the separation plates 80*a*–80*d* are raised for all of the cartridges 7*a*–7*d* for the yellow, magenta, cyan and black colors (FIG. 1), (2) the separation plates 80*a*–80*d* are not raised for any of the cartridges 7*a*–7*d* for the yellow, magenta, cyan or black color (FIG. 7), (3) the separation plates are raised only for the cartridges 7*a*–7*d* for the yellow, magenta and cyan colors (FIG. 8). In order to make these three modes selectable, the toner container 41 is provided with two pairs of force receiving portions as shown in FIG. 9, in this embodiment. The cartridges (7*a*–7*c*) accommodating the yellow color, magenta color and cyan color developers are brought into and out of contact, using the force receiving portions 46L, 46R. On the other hand, the cartridge 7 (7*d*) accommodating the black color developer is brought into and out of contact, using the force receiving portions 55L, 55R. The main assembly of the apparatus has two pairs of separation plates 80*a*–80*c* for the cartridges (7*a*–7*c*) accommodating the yellow color, magenta color and cyan color developers and plates 80*d* for the cartridge 7 (7*d*) accommodating the black color developer.

In this embodiment, when the cartridge 7 is mounted to the main assembly 100 of apparatus, the separation plates 80*a*–80*d* are raised for the yellow, magenta, cyan and black color cartridges 7 (all cartridges), as shown in FIG. 1. Therefore, with the mounting operation of the cartridge 7, the force receiving portion 46 provided in the developing unit 4 rides on the separation plate for that unit. By doing so, the developing roller 40 is separated from the photosensitive drum 1 by a predetermined gap. The separated state is maintained in the period in which the main switch is not actuated, or the developing operation is not carried out. Therefore, even if the cartridge 7 is left unused for a long term with the cartridge 7 set in the main assembly, the permanent deformation of the developing roller layer which may occur as a result of long-term contact of the developing roller 40 to the photosensitive drum 1, will not occur.

When the image forming operation is started in response to the printing signal, the raising of the separation plate is released in a timed relation with the developing operation. By this, the separation plate is lowered. The force receiving portions 46, 55L, 55R are separated from the separation plate 80. Then, the developing roller 40 is brought into contact to the photosensitive drum 1 by the elastic force of the spring 54, and the operable state of developing action is established. In the case of a full color mode, the developing roller 40 contacts the photosensitive drum 1 in all of the cartridges 7 for the yellow, magenta, cyan and black, as shown in FIG. 7. Thus, the separation plate is separated from the force receiving portions 46, 55L, 55R. In the case of a monocolor mode, the developing roller 40 contacts the photosensitive drum 1 only in the cartridge 7*d* for the black color, as shown in FIG. 8. Thus, the separation plate 80*d* is separated from the force receiving portions 46, 55L, 55R. In this manner, the image forming operations are carried out corresponding to the respective color modes.

The foregoing embodiment is summarized as the following process cartridge. That is:

A process cartridge detachably mountable to a main assembly (100) of an electrophotographic image forming apparatus, comprising:

a first frame (photosensitive drum unit 50);

a second (4) frame coupled with the first frame for rotation about a shaft (49);

an electrophotographic photosensitive drum (1) provided in the first frame;

a developing member (developing roller 40), provided in thea second frame, for developing an electrostatic latent image formed on the photosensitive drum with a developer; a developing member, provided in the second frame, for developing an electrostatic latent image formed on the photosensitive drum with a developer (t);

an elastic member (spring 54, 90) for applying an elastic force between the first frame and the second frame to urge the developing member to the photosensitive drum;

a force receiving portion (46, 55L, 55R), provided downstream of the shaft with respect to a mounting direction (Y in FIG. 2) in which the process cartridge is mounted to the main assembly of the image forming apparatus, for receiving a force from the main assembly of the image forming apparatus to keep the developing member away from the photosensitive drum when the process cartridge is mounted to the main assembly of the image forming apparatus; and a limiting portion (56*a*, 56*b*) for limiting upward movement of the first frame.

The limiting portion 56*a* is engaged with a locking portion 32*d* provided in the side plate 32. The limiting portion 56*b* is engaged with a locking portion 32*c* of a rear side plate 32*e* provided in the main assembly 100 of the apparatus. By doing so, the force from the main assembly 100 of the apparatus is applied to the force receiving portions 46, 55L, 55R, so that upward movement of the unit 50 is prevented. Therefore, the downstream side of the unit 50 with respect to the mounting direction Y is raised rotationally about the shaft 49. By this, the developing roller 40 is separated from the photosensitive drum 1. The limiting portion 56*a* functions as a guide when the cartridge 7 is mounted to the main assembly 100. The limiting portion 56*b* functions as a guide for positioning the cartridge relative to the main assembly 100.

The force receiving portions 46, 55, 55R are provided at one and the other longitudinal end portions of the developing unit 4.

The force receiving portions 46, 55L, 55R are provided at two positions (46L, 55L) at one longitudinal end portion of the developing unit 4 and at two positions (46R, 55R) at the other longitudinal end portion of the developing unit 4. The four force receiving portions 46L, 46R, 55L, 55R face the rear when the cartridge 7 is mounted to the main assembly 100 of the apparatus. When the cartridge 7*d* contains the developer for black color development, one force receiving portion 55L at one end portion and one force receiving portion 55R at the other end portion receive the upward force from the main assembly 100 of the apparatus. In the case of the cartridges 7*a*–7*c* containing the developer for other than black color development, the other force receiving portion 46L disposed at one end portion and the other force receiving portion 46R at the other end portion receive the force from the main assembly 100 of the apparatus.

The process cartridge 7 further comprises laser beam path 70 for permitting passage of a laser beam to be projected onto the photosensitive drum 1 from the main assembly 100 of the image forming apparatus when the process cartridge 7 is mounted to the main assembly 100 of an image forming apparatus. The laser beam path 70 is disposed between the frame 50 the frame 4 at a downstream portion with respect to the mounting direction (Y). The force receiving portion is disposed at such a position that the force receiving portion does not interfere with the laser beam path 70 with respect to a vertical direction when the process cartridge 7 is mounted to the main assembly 100 of image forming apparatus. By this, the force applying means 8 provided in the main assembly 100 of apparatus does not block the optical path for the laser beam.

The contact position C where the photosensitive drum 1 and the developing roller 40 contact each other (FIG. 2), is disposed upstream of the shaft 49 in the mounting direction Y (FIG. 2).

The limiting portion 56*a* (FIGS. 11, 12) is disposed at one end portion of the unit 50 with respect to a direction crossing with the mounting direction Y and at a downstream side with respect to the mounting direction Y, and is projected from the unit 50 in the crossing direction.

The limiting portion 56*c* indicated by chain lines with three dots in FIGS. 11 and 12, is disposed at the other end portion of the unit 50 with respect to a direction crossing with the mounting direction Y and at a downstream portion with respect to the mounting direction Y, and is projected from the unit 50 in the crossing direction. In this embodiment, a limiting portion 56*c* is provided in place of the limiting portion 56*b* shown in FIG. 11 and FIG. 12. Therefore, this embodiment as shown in FIGS. 11 and 12 uses the limiting portion 56*a* and the limiting portion 56*c* in combination.

The limiting portion 56*b* (FIGS. 11, 12) is disposed at the other end portion of the unit 50 with respect to the direction crossing with the mounting direction Y and that leading end portion in the mounting direction Y, and is projected from the unit 50 in the downstream direction with respect to the mounting direction Y.

The process cartridge further includes, at one and the other longitudinal end portions of the photosensitive drum 1, a member (bearing 31) disposed coaxially with a photosensitive drum 1. When the cartridge 7 is mounted to the main assembly 100 of apparatus, the spring 30 provided in the main assembly 100 of the apparatus is pressed elastically against the bearing 31.

The spring (the elastic member) is disposed at each of one and the other longitudinal end portions of the unit 4 and unit 50. At one end portion, there is provided a pressing spring 54 in the form of a compression coil spring, and at the other end portion, there is provided a pressing spring 90 in the form of a stretching spring. With this structure, the developing roller 40 can be stably urged to the photosensitive drum 1.

The mounting portion of the main assembly 100 includes one mounting means 100*d* for mounting a process cartridge 7*d* for black color development and three mounting means 100*a*–100*c* for mounting the process cartridges 7*a*–7*c* for non-black color development, and wherein the force applying portion 8 includes a first force applying means 81 for applying the force to the force receiving portions 55L, 55R of the process cartridge 7*d* for black color development mounted to the mounting means 100*d* therefor, and second force applying means 82 for applying the force to the force receiving portions 46L, 46R of the process cartridges 7*a*–7*d* for non-black color development. The first force applying means 81 and the second force applying means 82 are movable in the vertical direction independently from each other.

The separating mechanism is summarized as follows:

A separating mechanism for separating a developing member (40) from an electrophotographic photosensitive drum provided in a process cartridge detachably mountable, the separating mechanism comprising:

(A) a main assembly (100) of an electrophotographic image forming apparatus, to which the process cartridge is detachably mountable, the main assembly including a force applying means (8); and (B) a mounting portion for mounting the process cartridge, the process cartridge including:

a first frame (photosensitive drum unit 50);

a second frame (developing unit 4) coupled with the first frame for rotation about a shaft (49);

an electrophotographic photosensitive drum (1) provided in the first frame;

a developing member (developing roller 40), provided in the second frame, for developing an electrostatic latent image formed on the photosensitive drum with a developer (t);

an elastic member (spring 54) for applying an elastic force between the first frame and the second frame to urge the developing member to the photosensitive drum;

a force receiving portion (46, 55L, 55R), provided downstream of the shaft with respect to a mounting direction (Y in FIG. 2) in which the process cartridge is mounted to the main assembly of the image forming apparatus, for receiving a force from the main assembly of the image forming apparatus to keep the developing member away from the photosensitive drum when the process cartridge is mounted to the main assembly of the image forming apparatus; and a limiting portion (56*a*, 56*b*) for limiting upward movement of the first frame, wherein a force for raising the second frame upwardly is applied to the force receiving portion by the force applying means of the main assembly of the image forming apparatus while the limiting portion limits the upward movement of the first frame, to keep the developing member away from the photosensitive drum.

As described in the foregoing, the cartridge 7 comprises the developing unit 4 and the photosensitive member unit 50 which are pivotable about the shaft 49 (pivoted). When the cartridge 7 is not mounted to the main assembly of the apparatus, the developing unit 4 is normally urged by the spring 54 in the direction of contacting the developing roller 40 to the photosensitive drum 1. Therefore, when the separating action is released, that is, during the image forming operation, a stabilized contact pressure is applied to the photosensitive drum 1 by the spring pressure of the spring 54 alone, without the inclines of the other structures of the main assembly.

As shown in FIG. 10, the pressing spring may be a stretching spring applying a tension force between the neighborhood of the center of the photosensitive drum 1 and the neighborhood of the center of the developing roller. It is a possible alternative to use the compression coil spring (pressing spring 54) shown in FIG. 2 and the stretching spring (pressing spring 90) shown in FIG. 10 in combination. In the foregoing embodiment, the spring 54 and the spring 90 are used in combination as shown in FIGS. 2 and 10.

In this embodiment, the two pairs of force receiving portions 46L, 46R, 55L, 55R are used and are arranged in the axial direction of the photosensitive drum 1. However, more force receiving portions may be used depending on the mode control. On the other hand, only one force receiving portion may be used. In this embodiment, the cartridge 7*d* for the black color development and the cartridges 7*a*–7*c* for the non-black color development are used. For this reason, at least two force receiving portions are necessary. However, if this is not the case, only one force receiving portion is enough. However, from the standpoint of assured separating action, it is preferable to use a plurality of force receiving portions.

In this embodiment, a description has been provided with respect to the developing apparatus of a contact developing system, but the present invention is applicable to a non-contact developing system. In this case, the present invention is effected to avoid production of a trace of pressing by a spacer roller for example.

As described in the foregoing, according to these embodiments, the two states, namely, contact and separation between the photosensitive drum and the developing roller, are easily selectively established. Therefore, the permanent deformation of the roller due to the contact of the developing roller to the photosensitive drum can be assuredly avoided. By releasing the separating action only during the image forming operation, the deposition of the developer from the developing roller to the photosensitive drum can be avoided when the bias voltage is not applied to the process cartridge. Therefore, the possible contamination of the recording media due to the developer can be avoided.

According to the present invention, the electrophotographic photosensitive drum and the developing member can be separated with certainty. They can be separated with a simple structure.

While the invention has been described with reference to the structures disclosed herein, it is not confined to the details set forth and this application is intended to cover such modifications or changes as may come within the purpose of the improvements or the scope of the following claims.

What is claimed is:

1. A process cartridge detachably mountable to a main assembly of an electrophotographic image forming apparatus, comprising:

first frame;

a second frame coupled with said first frame and configured and positioned to rotate about a shaft;

an electrophotographic photosensitive drum provided in said first frame;

a developing member, provided in said second frame, configured and positioned to develop an electrostatic latent image formed on said photosensitive drum with a developer;

an elastic member configured and positioned to apply an elastic force between said first frame and said second frame to urge said developing member to said photosensitive drum;

a force receiving portion, provided downstream of the shaft with respect to a mounting direction in which said process cartridge is mounted to the main assembly of the image forming apparatus, and configured and positioned to receive a force from the main assembly of the image forming apparatus to keep said developing member away from said photosensitive drum when said process cartridge is mounted to the main assembly of the image forming apparatus; and a limiting portion configured and positioned to limit upward movement of said first frame by engagement of said force receiving portion with an engaging portion provided in the main assembly.

2. A process cartridge according to claim 1, wherein said force receiving portion is disposed at each of longitudinal end portions of said second frame.

3. A process cartridge according to claim 2, wherein said force receiving portion is provided at each of two positions at one longitudinal end portion and at each of two positions at the other longitudinal end portion to provide four force receiving portions, wherein said four force receiving portions face downward when said process cartridge is mounted to the main assembly of the image forming apparatus, wherein when said process cartridge accommodates a developer for development with a black color, one of said force receiving portions disposed at said one longitudinal end portion and one of said force receiving portions disposed at the other longitudinal end portion receive the force from the main assembly of the image forming apparatus; and when said process cartridge accommodates a developer for development with a color other than black color, the other of said force receiving portions disposed at the one longitudinal end portion and the other of said force receiving portions disposed at the other longitudinal end portion receive the force from the main assembly of the image forming apparatus.

4. A process cartridge according to claim 2, further comprising a laser beam path configured and positioned to permit passage of a laser beam to be projected onto said photosensitive drum from the main assembly of the image forming apparatus when said process cartridge is mounted to the main assembly of an image forming apparatus, said laser beam path being disposed between said first frame and said second frame at a downstream portion with respect to the mounting direction, wherein said force receiving portion is disposed at such a position that said force receiving portion does not interfere with the laser beam path with respect to a vertical direction when said process cartridge is mounted to the main assembly of the image forming apparatus.

5. A process cartridge according to claim 1, 2, 3 or 4, wherein said developing member is in the form of a developing roller, is contacted to said photosensitive drum, and is upstream of the shaft with respect to the mounting direction.

6. A process cartridge according to claim 1, 2, 3 or 4, wherein said first frame has first and second end portions, wherein said limiting portion is disposed at said first end portion of said first frame with respect to a direction crossing the mounting direction and at a downstream side of said first frame with respect to the mounting direction, and said limiting portion is projected from said first frame with respect to the direction crossing the mounting direction.

7. A process cartridge according to claim 1, 2, 3 or 4, wherein said first fram comprises first and second end portions, wherein said limiting portion is disposed at said second end portion of said first frame with respect to a direction crossing the mounting direction and at a downstream side of said first frame with respect to the mounting direction, and said limiting portion is projected from said first frame with respect to the direction crossing the mounting direction.

8. A process cartridge according to claim 6, wherein said limiting portion is disposed at said second end portion of said first frame with respect to a direction crossing the mounting direction and at a leading end portion with respect to the mounting direction, and said limiting portion is projected from said first frame toward downstream direction with respect to the mounting direction.

9. A process cartridge according to claim 1, 2, 3 or 4, further comprising a member disposed at a position on an axis of said photosensitive drum at one and the other longitudinal ends of said photosensitive drum, wherein a spring provided in the main assembly of the image forming apparatus elastically presses against said member when said process cartridge is mounted to the main assembly of the image forming apparatus.

10. A process cartridge according to claim 4, wherein said plastic member is disposed at one and the other longitudinal and portions of the laser beam path at such a position as not to interfere the laser beam path.

11. A process cartridge detachably mountable to a main assembly of an electrophotographic image forming apparatus, comprising:

a first frame;

a second frame coupled with said first frame and configured and positioned to rotate about a shaft;

an electrophotographic photosensitive drum provided in said first frame;

a developing roller, provided in said second frame, and configured and positioned to develop an electrostatic latent image formed on said photosensitive drum with a developer;

a spring configured and positioned to apply an elastic force between said first frame and said second frame to urge said developing roller to said photosensitive drum;

a laser beam path configured and positioned to permit passage of a laser beam to be projected onto said photosensitive drum from the main assembly of the image forming apparatus when said process cartridge is mounted to the main assembly of the image forming apparatus, said laser beam path being disposed between said first frame and said second frame at a downstream portion with respect to a mounting direction in which said process cartridge is mounted to the main assembly;

a force receiving portion, provided downstream of the shaft in said second frame with respect to the mounting direction, and configured and positioned to receive a force from the main assembly of the image forming apparatus to keep said developing roller away from said photosensitive drum when said process cartridge is mounted to the main assembly of the image forming apparatus, wherein said force receiving portion is disposed at one and the other longitudinal end portions of said process cartridge at such positions that said force receiving portion does not interfere with said laser beam path with respect to a vertical direction when said process cartridge is mounted to the main assembly of the image forming apparatus;

a first limiting portion configured and positioned to limit upward movement of said first frame by engagement of said force receiving portion with an engaging portion provided in the main assembly, wherein said first limiting portion is disposed at one end portion of said first frame with respect to a direction crossing the mounting direction and at a downstream side of said first frame with respect to the mounting direction, and said first limiting portion is projected from said first frame in a direction crossing the mounting direction; and a second limiting portion configured and positioned to limit upward movement of said first frame by engagement of said force receiving portion with an engaging portion provided in the main assembly, wherein said second limiting portion is disposed at the other end portion of said first frame with respect to a direction crossing the mounting direction and at a downstream side of said first frame with respect to the mounting direction, and said second limiting portion is projected from said first frame with respect to the direction crossing the mounting direction, wherein a contact position where said developing roller contacts said photosensitive drum is upstream of the shaft.

12. A process cartridge detachably mountable to a main assembly of an electrophotographic image forming apparatus, comprising:

a first frame;

a second frame coupled with said first frame and configured and positioned to rotate about a shaft;

an electrophotographic photosensitive drum provided in said first frame;

a developing roller, provided in said second frame, and configured and positioned to develop an electrostatic latent image formed on said photosensitive drum with a developer;

a spring configured and positioned to apply an elastic force between said first frame and said second frame to urge said developing roller to said photosensitive drum;

a laser beam path configured and positioned to permit passage of a laser beam to be projected onto said photosensitive drum from the main assembly of the image forming apparatus when said process cartridge is mounted to the main assembly of the image forming apparatus in a mounting direction, said laser beam path being disposed between said first frame and said second frame at a downstream portion with respect to the mounting direction;

a force receiving portion, provided downstream of the shaft with respect to the mounting direction, and configured and positioned to receive a force from the main assembly of the image forming apparatus to keep said developing roller away from said photosensitive drum when said process cartridge is mounted to the main assembly of the image forming apparatus, wherein said force receiving portion is disposed at one and the other longitudinal end portions of said process cartridge at such positions that said force receiving portion does not interfere with the laser beam path with respect to a vertical direction when said process cartridge is mounted to the main assembly of the image forming apparatus;

a first limiting portion configured and positioned to limit upward movement of said first frame by engagement of said force receiving portion with an engaging portion provided in the main assembly, wherein said first limiting portion is disposed at one end portion of said first frame with respect to a direction crossing with the mounting direction and at a downstream side of said first frame with respect to the mounting direction, and said first limiting portion is projected from said first frame with respect to the direction crossing the mounting direction; and a second limiting portion configured and positioned to limit upward movement of said first frame by engagement of said force receiving portion with an engaging portion provided in the main assembly, wherein said second limiting portion is disposed at the other end portion of said first frame with respect to a direction crossing the mounting direction and at a leading end portion with respect to the mounting direction, and said second limiting portion is projected from said first frame in the mounting direction, wherein a contact position where said developing roller contacts said photosensitive drum is upstream of the shaft.

13. An electrophotographic image forming apparatus for forming an image on a recording material, to which a process cartridge is detachably mountable, said apparatus comprising:

(A) a force applying portion; and (B) a mounting portion configured and positioned to mount the process cartridge, the process cartridge including:

a first frame;

a second frame coupled with the first frame and configured and positioned to rotate about a shaft;

an electrophotographic photosensitive drum provided in the first frame;

a developing member, provided in the second frame, and configured and positioned to develop an electrostatic latent image formed on said photosensitive drum with a developer;

an elastic member configured and positioned to apply an elastic force between the first frame and the second frame to urge said developing member to the photosensitive drum;

a force receiving portion, provided downstream of the shaft with respect to a mounting direction in which the process cartridge is mounted to the main assembly of said image forming apparatus, and configured and positioned to receive a force from said force applying portion of said image forming apparatus to keep the developing member away from the photosensitive drum when the process cartridge is mounted to said main assembly of said image forming apparatus; and a limiting portion configured and positioned to limit upward movement of the first frame by engagement of said force receiving portion with an engaging portion provided in the main assembly.

14. An electrophotographic image forming apparatus for forming an image on a recording material, to which a process cartridge is detachably mountable, said apparatus comprising:

(A) a force applying portion; and (B) a mounting portion configured and positioned to mount the process cartridge, the process cartridge including:

a first frame;

a second frame coupled with the first frame and configured and positioned to rotate about a shaft;

an electrophotographic photosensitive drum provided in the first frame;

a developing roller, provided in the second frame, and configured and positioned to develop an electrostatic latent image formed on the photosensitive drum with a developer;

a spring configured and positioned to apply an elastic force between the first frame and the second frame to urge the developing roller to the photosensitive drum;

a laser beam path configured and positioned to permit passage of a laser beam to be projected onto the photosensitive drum from the main assembly of said image forming apparatus when the process cartridge is mounted to said main assembly of said image forming apparatus in a mounting direction, the laser beam path being disposed between the first frame and the second frame at a downstream portion of the process cartridge with respect to the mounting direction;

a force receiving portion, provided downstream of the shaft in said second frame with respect to the mounting direction, and configured and positioned to receive a force from said force applying portion of said image forming apparatus to keep the developing roller away from the photosensitive drum when the process cartridge is mounted to said main assembly of said image forming apparatus, wherein said force receiving portion is disposed at one and the other longitudinal end portions of the process cartridge at such positions that said force receiving portion does not interfere with the laser beam path with respect to a vertical direction when the process cartridge is mounted to said main assembly of said image forming apparatus;

a first limiting portion configured and positioned to limit upward movement of the first frame by engagement of said force receiving portion with an engaging portion provided in the main assembly, wherein the first limiting portion is disposed at one end portion of the first frame with respect to a direction crossing the mounting direction and at a downstream side of the first frame with respect to the mounting direction, and the first limiting portion is projected from the first frame with respect to the direction crossing the mounting direction; and a second limiting portion configured and positioned to limit upward movement of the first frame by engagement of said force receiving portion with an engaging portion provided in the main assembly, wherein the second limiting portion is disposed at the other end portion of the first frame with respect to a direction crossing the mounting direction and at a downstream side of the first frame with respect to the mounting direction, and the second limiting portion is projected from the first frame with respect to the direction crossing the mounting direction, wherein a contact position where the developing roller contacts the photosensitive drum is upstream of the shaft.

15. An electrophotographic image forming apparatus for forming an image on a recording material, to which a process cartridge is detachably mountable, said apparatus comprising:

(A) a force applying portion; and (B) a mounting portion configured and positioned to mount the process cartridge, the process cartridge including:

a first frame;

a second frame coupled with the first frame and configured and positioned to rotate about a shaft;

an electrophotographic photosensitive drum provided in the first frame;

a developing roller, provided in the second frame, and configured and positioned to develop an electrostatic latent image formed on said photosensitive drum with a developer;

a spring configured and positioned to apply an elastic force between the first frame and the second frame to urge the developing roller to the photosensitive drum;

a laser beam path configured and positioned to permit passage of a laser beam to be projected onto the photosensitive drum from a main assembly of said image forming apparatus when the process cartridge is mounted to said main assembly of said image forming apparatus in a mounting direction, the laser beam path being disposed between the first frame and the second frame at a downstream portion with respect to the mounting direction;

a force receiving portion, provided downstream of the shaft with respect to the mounting direction, and configured and positioned to receive a force from said force applying portion of said image forming apparatus to keep the developing roller away from the photosensitive drum when the process cartridge is mounted to said main assembly of said image forming apparatus, wherein the force receiving portion is disposed at one and the other longitudinal end portions of the process cartridge at such a position that the force receiving portion does not interfere with the laser beam path with respect to a vertical direction when the process cartridge is mounted to said main assembly of said image forming apparatus;

a first limiting portion configured and positioned to upward movement of the first frame by engagement of said force receiving portion with an engaging portion provided in the main assembly, wherein the first limiting portion is disposed at one end portion of the first frame with respect to a direction crossing the mounting direction and at a downstream side of the first frame with respect to the mounting direction, and the first limiting portion is projected from the first frame with respect to the direction crossing the mounting direction; and a second limiting portion configured and positioned to limit upward movement of the first frame by engagement of said force receiving portion with an engaging portion provided in the main assembly, wherein the second limiting portion is disposed at the other end portion of the first frame with respect to a direction crossing the mounting direction and at a leading end portion with respect to the mounting direction, and the second limiting portion is projected from the first frame in the mounting direction;

wherein a contact position where the developing roller contacts the photosensitive drum is upstream of the shaft.

16. An electrophotographic image forming apparatus according to any one of claims 13, 14 and 15, wherein said mounting portion includes one mounting means for mounting a process cartridge for black color development and three mounting means for mounting process cartridges for non-black color development, and wherein said force applying portion includes first force applying means for applying a force to the force receiving portion of the process cartridge for black color development mounted to the one mounting means therefor, and second force applying means for applying a force to the force receiving portions of the process cartridges for non-black color development.

17. A separating mechanism for separating a developing member from an electrophotographic photosensitive drum provided in a process cartridge, said separating mechanism comprising:

(A) a main assembly of an electrophotographic image forming apparatus, to which the process cartridge is detachably mountable, said main assembly including a force applying means for applying a force to the process cartridge; and (B) the process cartridge including:

a first frame;

a second frame coupled with said first frame and configured and positioned to rotate about a shaft;

an electrophotographic photosensitive drum provided in said first frame;

a developing member, provided in said second frame, and configured and positioned to develop an electrostatic latent image formed on said photosensitive drum with a developer;

an elastic member configured and positioned to apply an elastic force between said first frame and said second frame to urge said developing member to said photosensitive drum;

a force receiving portion, provided downstream of the shaft with respect to a mounting direction in which said process cartridge is mounted to said main assembly of said image forming apparatus, and configured and positioned to receive a force from said force applying means of said image forming apparatus to keep said developing member away from said photosensitive drum when said process cartridge is mounted to said main assembly of said image forming apparatus; and a limiting portion configured and positioned to limit upward movement of said first frame by engagement of said force receiving portion with an engaging portion provided in said main assembly, wherein a force for raising said second frame upwardly is applied to said force receiving portion by said force applying means of said main assembly of said image forming apparatus while said limiting portion limits the upward movement of said first frame, to keep said developing member away from said photosensitive drum.

18. A separating mechanism according to claim 17, wherein said force receiving portion is disposed at each of longitudinal end portions of said second frame.

19. A separating mechanism according to claim 18, wherein said force receiving portion is provided at two positions at the one longitudinal end portion and at two positions at the other longitudinal end portion so as to comprise four force receiving portions, wherein said four force receiving portions face downward when said process cartridge is mounted to said main assembly of said image forming apparatus, wherein when said process cartridge accommodates a developer for development with a black color, one of said force receiving portions disposed at the one longitudinal end portion and one of said force receiving portions disposed at the other longitudinal end portion receive the force from said force applying means of said apparatus and when said process cartridge accommodates a developer for development with a color other than a black color, the other of said force receiving portions disposed at the one longitudinal end portion and the other of the force receiving portions disposed at the other longitudinal end portion receive the force from said force applying means of said apparatus.

20. A separating mechanism according to claim 17, wherein said limiting portion is disposed at one end portion of said first frame with respect to a direction crossing the mounting direction and at a downstream side of said first frame with respect to the mounting direction, and said limiting portion is projected from said first frame with respect to the direction crossing the mounting direction.

* * * * *

UNITED STATES PATENT AND TRADEMARK OFFICE

CERTIFICATE OF CORRECTION

PATENT NO. : 6,681,088 B2
DATED : January 20, 2004
INVENTOR(S) : Kazuhiko Kanno et al.

It is certified that error appears in the above-identified patent and that said Letters Patent is hereby corrected as shown below:

Column 6,
Line 49, “shaft shaft” should read -- shaft --.

Column 8,
Line 47, “of” should read -- of the --.

Column 9,
Line 25, “thea” should read -- the --.

Column 10,
Line 57, “of” should read -- of the --.

Column 12,
Line 54, “first” should read -- a first -- .

Column 13,
Line 60, “fram” should read -- frame --.

Column 14,
Line 6, “toward” should read -- toward the --.
Line 18, “and” should read -- end --; and “as not” should read -- so as not --.
Line 19, “interfere” should read -- interfere with --.

Column 15,
Line 62, “with the” should read -- the --.

Signed and Sealed this

Thirteenth Day of July, 2004

JON W. DUDAS
*Acting Director of the United States Patent and Trademark Office*